United States Patent [19]

Dassi et al.

[11] Patent Number: 4,810,855

[45] Date of Patent: Mar. 7, 1989

[54] COMBINED SET OF HOUSEHOLD ELECTRICAL APPLIANCES AND A HANDGRIP THEREFOR

[75] Inventors: Francesco Dassi, Novara; Ferdinando Nebuloni; Cosimo Sormani, both of Parabiago, all of Italy

[73] Assignee: MAGIC LINE S.p.A., Nerviano, Italy

[21] Appl. No.: 851,574

[22] Filed: Apr. 14, 1986

[30] Foreign Application Priority Data

Apr. 24, 1985 [IT] Italy ..... 21635/85[U]

[51] Int. Cl.[4] ..... H05B 1/00; D06F 75/08; H01H 9/06; H01R 11/00

[52] U.S. Cl. ..... 219/361; 38/74; 38/92; 200/61.85; 219/245; 219/474; 439/217

[58] Field of Search ..... 16/110 R, 114 R, 114 A, 16/114 B, 116 R, 118; 339/58, 14 P, 14 T, 75 M; 200/61.85; 38/90–92, 74; 219/370, 245, 361, 474; 439/217, 516

[56] References Cited

U.S. PATENT DOCUMENTS

| | | | |
|---|---|---|---|
| 2,715,175 | 8/1955 | Jacobson | 219/227 |
| 3,023,295 | 2/1962 | Johnson | 219/237 |
| 3,120,987 | 2/1964 | Degnan et al. | 339/75 M |
| 3,525,971 | 8/1970 | Glassman | 339/14 P |
| 3,766,673 | 10/1973 | Harroff | 38/90 |
| 3,843,224 | 10/1974 | Gerke, Jr. et al. | 339/58 |
| 3,947,081 | 3/1976 | Peterson | 339/75 M |
| 3,952,239 | 4/1976 | Owings et al. | 339/58 |
| 3,955,064 | 5/1976 | Demeterio et al. | 219/225 |
| 4,524,263 | 6/1985 | Yamac | 219/361 |
| 4,530,553 | 7/1985 | Aujla | 339/75 M |
| 4,531,798 | 7/1985 | Baur et al. | 339/75 M |
| 4,549,779 | 10/1985 | Gromek et al. | 339/58 |
| 4,636,613 | 1/1987 | de la Morandiere et al. | 219/361 |

FOREIGN PATENT DOCUMENTS

| | | | |
|---|---|---|---|
| 1043449 | 11/1958 | Fed. Rep. of Germany | 339/75 M |

*Primary Examiner*—A. D. Pellinen
*Assistant Examiner*—Geoffrey S. Evans
*Attorney, Agent, or Firm*—Guido Modiano; Albert Josif

[57] ABSTRACT

A combined set of household electrical appliances and a handgrip therefor, includes a handgrip element removably coupleable with the bodies of electrical household appliances. The handgrip element has a coupling element removably coupleable with a corresponding coupling seat defined by the electric household appliances. The handgrip element is provided with a connecting cable for connection to the mains connected to electric contacts provided at the coupling element and adapted to be arranged in electric conduction connection to coupling electric contacts provided in the cited coupling seat.

5 Claims, 3 Drawing Sheets

1
71
70

1
2

1
3

41
42
44
43
78
12
76

74
75
16a
16
72
17

73
72
10
100
13
101
16b
19
11
78
18
14
12
2

15
76

COMBINED SET OF HOUSEHOLD ELECTRICAL APPLIANCES AND A HANDGRIP THEREFOR

BACKGROUND OF THE INVENTION

This invention relates to a combined set of household electrical appliances and a handgrip therefor.

As is known presently available on the market are hair driers and flatirons which are defined for the traveller, because in order to be less bulky and lighter in weight, these appliances are manufactured in smaller sizes than the corresponding household appliances for domestic use. In an attempt to further reduce the overall size of both hair driers and flatirons, of the so-called traveller's type, these have been already made with the feature of foldable handgrip elements, so as to afford orderly stowage in the luggage.

Such applicances are supplied individually with a rigid or soft case, and are in many cases provided with adapter plugs for international electric mains sockets, in addition to the possibility of including a supply voltage change to accommodate the various mains.

With the known art solutions, however, these household appliances prevent the attainment of an optimum solution to the problem of reducing to a minimum the space reserved in the luggage, because they consitute at present two separate units with two discrete bulk sizes.

Another drawback attributable to the known art solutions is that, while having voltage-changer devices on their interiors, they are presently uncapable of preventing incidental wrong connection to the electric mains, with the likelihood of the electric component parts becoming damaged.

SUMMARY OF THE INVENTION

The aim proposed for the invention is indeed that of eliminating the previously encountered drawbacks by providing a combined set of electric appliances and a handgrip therefor, which afford a rationally built assembly, wherein a single handgrip can be easily utilized for a number of household appliances consisting, for example, of a hair drier and flatiron.

Within the above aim, it is a particular object of the invention to provide a combined set of household electrical appliances and a handgrip therefor, which affords the faculty of preventing accidental wrong electric connections, because the possibility of the household appliance being supplied with a higher voltage than the nominal voltage is not accidentally possible, but requires effectuation of two successive movements which rule out, accordingly, unintentionality of the wrong connection.

Another object of this invention is to provide a combined set of household appliances and a handgrip therefor, which affords the possibility of drastically reducing bulk dimensions, providing a handgrip usable selectively with the various household appliances connectable thereto, and therefore, with the possibility of simplifying all aspects inherent to bulk and electric connection.

A not least object of this invention is to provide a combined set which is particularly practical and functional, and which can give full assurance of being reliable and safe to use.

The above mentioned aim, and the outlined objects and more to become apparent hereinafter, are achieved by a combined set of household electrical appliances and a handgrip therefor, according to the invention, characterized in that it comprises a handgrip element removably coupleable with the bodies of household appliances, said handgrip element having a coupling element removably coupleable with a corresponding coupling seat defined by said household appliances, said handgrip element being provided with a connection cable for connection to the electric mains and being electrically connected to electric contacts provided at said coupling element and being adapted to be arranged in electric conduction connection to coupling electric contacts provided in said coupling seat.

BRIEF DESCRIPTION OF THE DRAWINGS

Further features and advantages will become apparent from the following detailed description of a combined set of household appliances and a handgrip therefor, with reference to the accompanying illustrative and not limitative drawings, where.

DESCRIPTION OF THE PREFERRED EMBODIMENTS

Figures 1, 2, 3, 4, 6, 9:
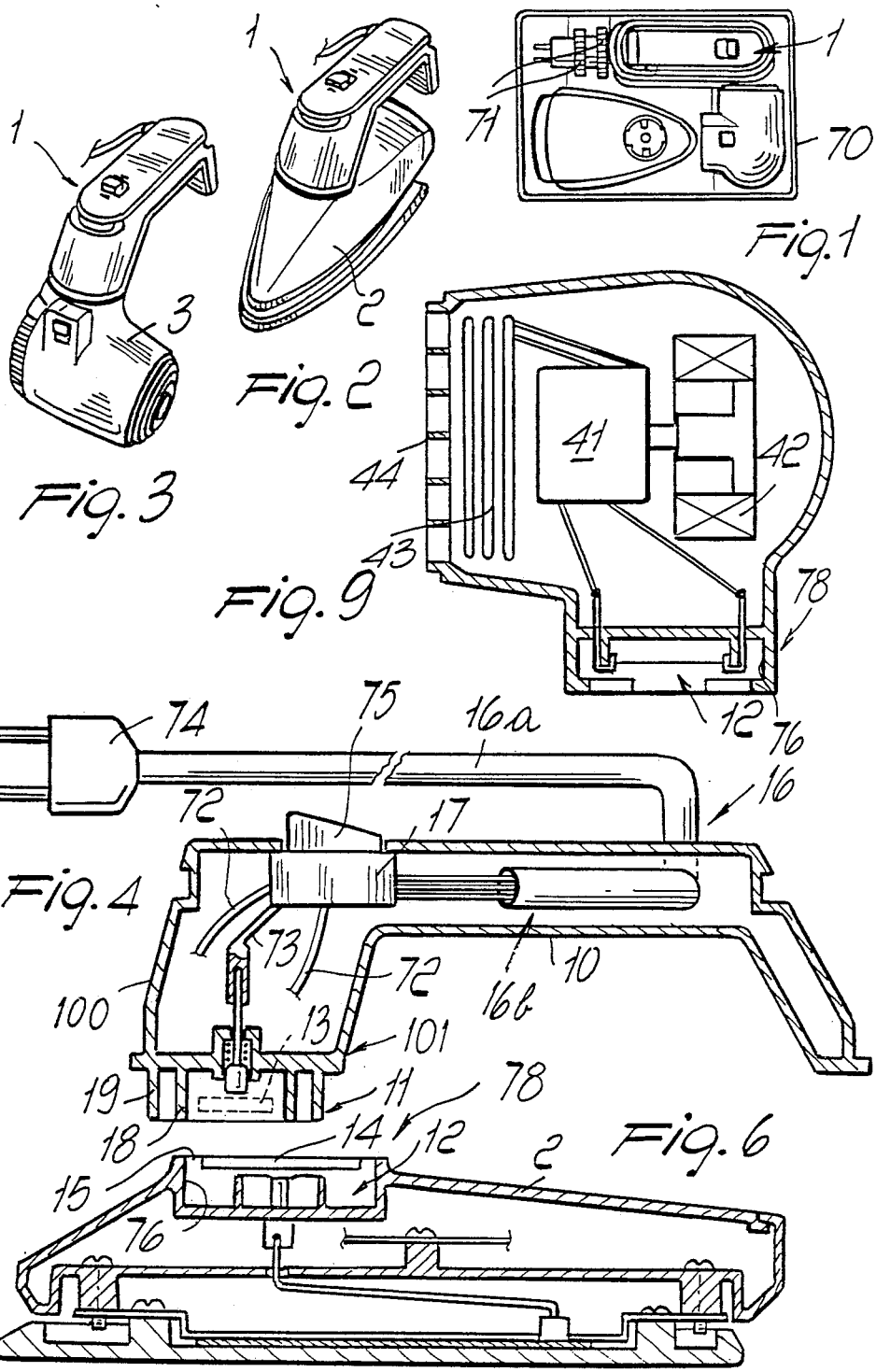
FIG. 1 shows diagrammatically the combined set, according to the invention, as disposed in a containment box.
FIG. 2 shows diagrammatically the handgrip as applied to a household appliance represented by a flatiron.
FIG. 3 shows diagrammatically the handgrip as applied to a household appliance represented by a hair drier.
FIG. 4 shows the handgrip in longitudinal section.
FIG. 6 shows, diagrammatically and in section, the flatiron.
FIG. 9 shows the hair drier diagrammatically in section.

With reference to the cited figures, the combined set of household electrical appliances and handgrip therefor, according to the invention, comprises a handgrip element, generally designated with the reference numeral 1, which may be removably coupleable with the bodies of electric household appliances comprising, for example, a flatiron 2 and a hair drier 3.

The cited handgrip element 1 has a body of elongate, substantially tubular conformaton 10 which at one end thereof defines a coupling element 11 which has a plane of lay disposed substantially laterally with respect to the longitudinal extent of the body 10. In particular, as visible the connecton end 101 is provided with a coupling element 11 protruding therefrom and defining a connecton formation laterally remote from the handgrip element 10.

The coupling element 11 is removably insertable into a coupling seat 12 which is defined at connection portons 78 of the main body of both the flatiron 2 and the hair drier 3. More particularly, each of the connection portions 78 comprises a cylindrical wall 76 partially protruding from the main body to define the coupling seat 12 for the coupling element 11. The wall 76 has a circular edge portion or border 14 radially and inwardly protruding from the wall and defining a restricted inlet substantially countershaped to the coupling element 11.

Advantageously, the mechanical coupling is of the bayonet type with juxtaposed male wings 13, preferably provided on the handgrip 1, which fit below the border 14 defined by the coupling seat 12 and provided with inlet cutouts 15.

The handgrip element 1 is provided with a cable 16 for connecton to the electric mains which, with the interposition of a switch 17 having an accessible operating pushbutton 75, is connected electrically to contacts provided at the coupling element. In particular, the cable 16, including two supply wires 72 and a ground wire 73, has a free portion **16*a* and an internal portion 16*b*, wherein the free portion 16*a* protrudes from the handgrip element 10 and has a free end connected with an electric plug 74 and the internal portion 16*b* extends in the handgrip element 10 and has a fixed end accomodated in the head portion 100** and secured to the handgrip electric contacts.

Figure 5:
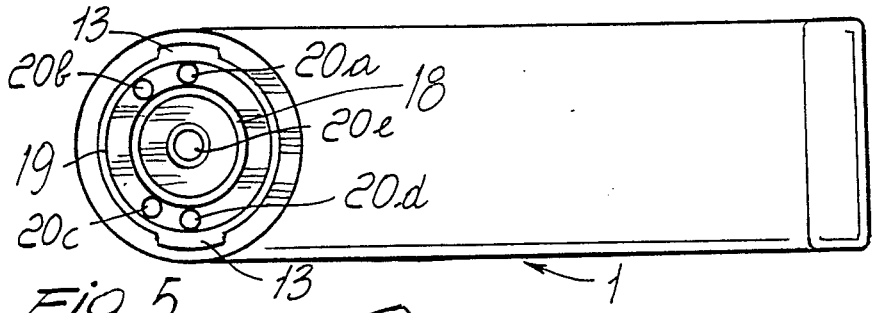
FIG. 5 is a view of the handgrip taken from the coupling element side.
Figure 7:
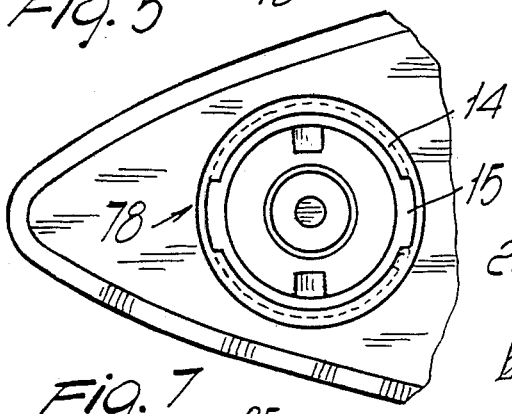
FIG. 7 shows the detail of the coupling seat on the flatiron.
Figure 8:
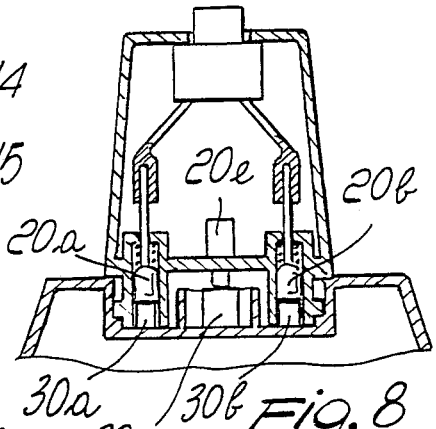
FIG. 8 shows in section the handgrip element as applied to the flatiron.

More in detail, the coupling element has an inner skirt 18 and an outer skirt or cylindrical projecton 19 arranged concentrically to each other, extending perpendicularly to the longitudinal direction of the tubular element 10 and defining an annular zone where electric contacts are provided which are generally indicated at 20 and elastically compliant. As visible from FIG. 5, the wings 13 are provided on the outer projection or skirt 19.

Figure 18:
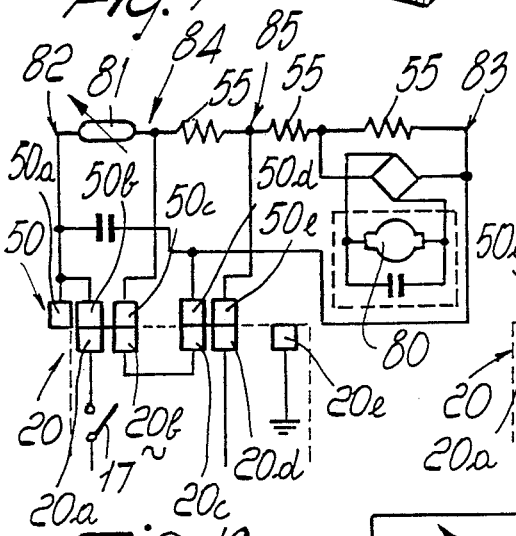
FIG. 18 shows the wiring diagram of the power supply to the hair drier at 110 Volts.
Figure 17:
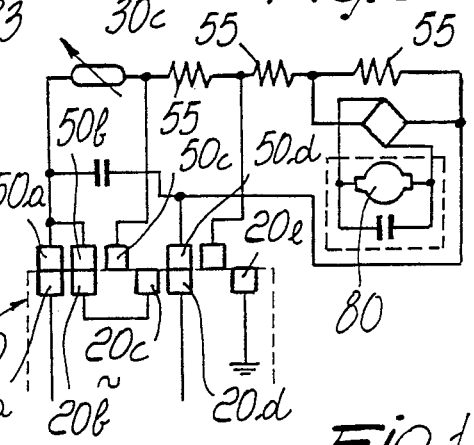
FIG. 17 shows the wiring diagram of the power supply to the hair drier at 220 Volts.
Figure 16:
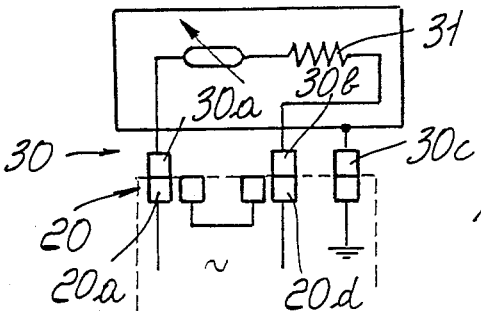
FIG. 16 shows diagrammatically the wiring diagram for powering the flatiron.
Figure 10:
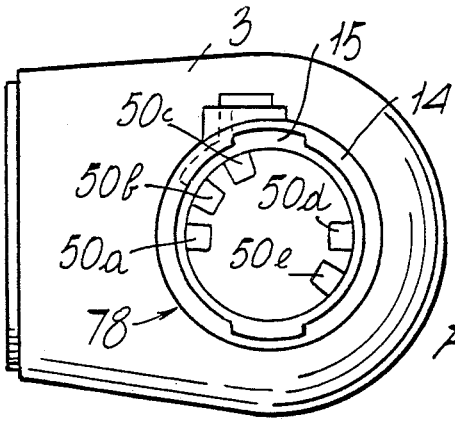
FIG. 10 shows diagrammatically the end of the handgrip having the coupling element.
Figure 11:
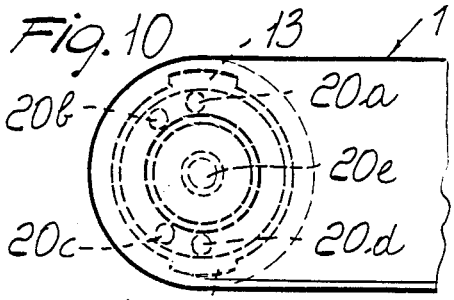
FIG. 11 shows the hair drier and the coupling seat associated therewith.
Figure 12:
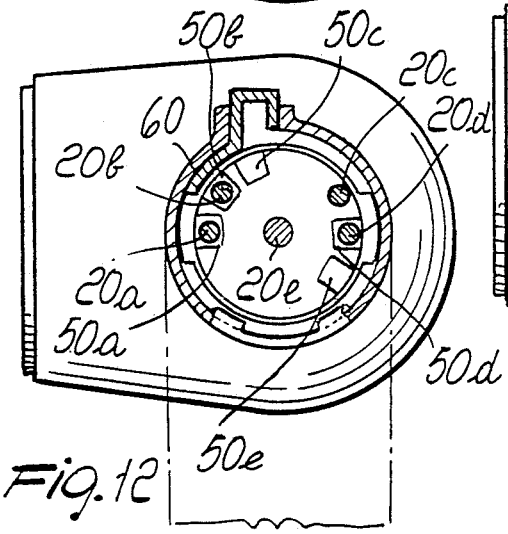
FIG. 12 shows in a partly cut-away view, the handgrip as applied to the hair drier, positioned for a voltage of 220 Volts.
Figure 13:
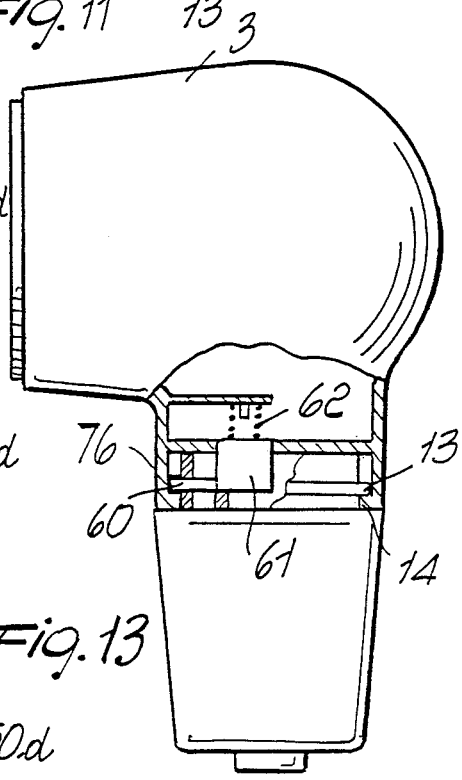
FIG. 13 is a partly cut-away view of the hair drier with the handgrip applied thereto, showing the positioning retainer element with a supply voltage of 220 Volts.

As shown best in the diagram of FIGS. 16 to 18 and in FIG. 10, the contacts 20 are arranged circumferentially, and more precisely, there is a first contact **20*a* for connection to one supply wire, a second contact 20*b* and a third contact 20*c* interconnected together and a fourth contact 20*d* connectable to the other supply wire. Also provided is a central ground contact generally indicated at 20*e***.

The household appliance consisting of the flatiron has correspondingly electric coupling contacts provided in the coupling seat 12.

Such contacts, in the instance of the household appliance consisting of the flatiron, which are generally designated with the reference numeral 30, have first and second coupling contacts **30*a* and 30*b*, for connection to the two supply wires, and a third contact 30*c*** for connection to the center contact constituting the ground.

The electric diagram of the flatiron contemplates on its interior an electric circuit including an ordinary regulating thermostat which feeds an electric resistance heater for the plate, generally indicated at 31.

Advantageously, the flatiron is usable with both the 110–120 Volts rating and the 220–240 Volts rating, with the one difference that in the instance of a power supply with the lower voltage rating, the times required for heating the plate are slightly longer.

The handgrip element 1 is also coupleable with the hair drier which has, on its interior, in a manner known per se, an electric user including a motor 41 that drives a fan 42 which introduces a flow of air through a resistance heater 43 provided at the outlet grid generally indicated at 44.

The hair drier 3 is also provided with a coupling seat 12, similar to the previously described one, with the difference that it has coupling electric contacts variously arranged to permit of the voltage change according to the different uses.

More in detail, correspondingly with the electric contacts 20 of the handgrip element there are provided in the coupling seat 12 of the hair drier 3 coupling contacts 50 distributed circumferentially, and consisting of a first **50*a*, of a second electric coupling contact 50*b* which are offset from each other angularly and connectable to a supply wire, also provided is a third electric coupling contact of the hair drier, indicated at 50*c* which serves a bypass function, as well as a fourth 50*d* and fifth 50*e* contact for hair drier coupling connectable to the other wire. In particular as visible from FIGS. 17 and 18, between the contacts 20 and the electric user, comprising here the motor 80, an electric circuit is arranged including a voltage divider formed of resistors 55 and potentiometer 81. The electric circuit defines two terminals 82 and 83, respectively connected to contacts 50*a*–50*b* and 50*d*, and two intermediate taps 84 and 85, respectively connected to contacts 50*c* and 50*e***.

As diagrammatically shown in FIG. 17, in the first position the first contact **20*a* is placed in electric coupling with the first contact 50*a*, and the fourth contact 20*d* is placed in electric coupling with the fourth contact 50*d* of the hair drier, in this condition there occurs full electric insertion of the resistors 55** provided within the hair drier with the possibility of obtaining the supply at 220–240 Volts.

In the diagram shown in FIG. 18 the first contact **20*a* goes into electric conduction with the second contact 50*b* thus connecting it to one supply wire, whilst the second and third contacts 20*b* and 20*c* form an electric bypass between the third contact 50*c* and the fourth contact 50*d*, excluding in practice from operation some of the electric resistors, the fourth contact 20*d* is interconnected to the fifth contact 50*e*** to connect it to the other supply wires.

The change in the supply voltage is accomplished by a different angular setting on the handgrip element 1 with respect to the hair drier, and there is provided a locking element which prevents accidental overloading of the hair drier electric circuit; that retainer element comprises a locking segment 60 which engages by contact with one of the wings 13 preventing their further rotation, thereby the electric contacts of the handgrip arrange themselves in accordance with the wiring diagram of FIG. 17.

The retainer segment 60 is connected to a slider 61 biased elastically by a spring 62 and being accessible from outside the hair drier.

Figure 14:
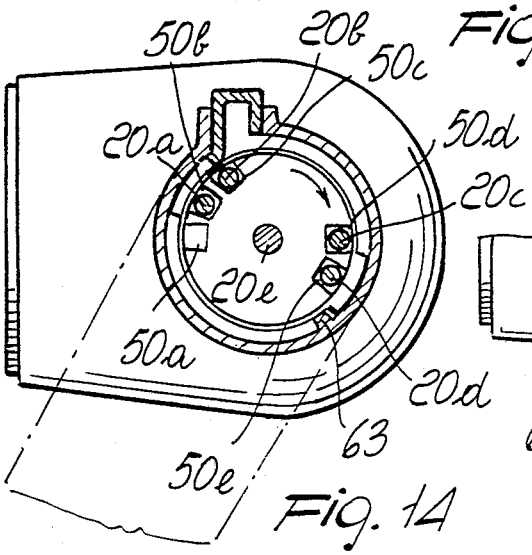
FIG. 14 shows, partly in cut-away view, the hair drier with the handgrip applied for a supply voltage of 110 Volts.
Figure 15:
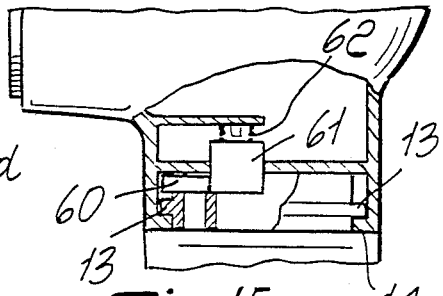
FIG. 15 shows the positioning of the retainer element for a supply voltage of 110 Volts.

If the electric power supply at 110–120 Volts is to be effected, it is sufficient to act on the slider 61 to overcome the elastic bias of the spring 62 and consequently disengage the segment 60 from the wing 13, so as to allow a further rotation distance for the handgrip element in the coupling phase, as shown in FIG. 14, thus enabling positioning of the electric contacts in conformity with the diagram shown in FIG. 18.

Thus, accidental overloading of the hair drier's electric components is made impossible, because to permit powering at the lowest voltage value, that is the voltage of 110–120 Volts, it is necessary to carry out a subsequent operation consisting of translating the slider 61 to disengage the removable lock.

Also provided in the coupling seat 12 is a retainer dog 63 which couples with the other of the wings 13 to carry out the proper positioning of the handgrip element for a 110–120 Volts supply.

When the handgrip is removed, the spring 12 acts to automatically return the slider 61 to the initial position, with consequent positioning in the retained conditions of the segment 60.

It should be also added to the foregoing that the handgrip element, and the household appliances described, consisting of the flatiron and the hair drier, may be housed within a containing box 70 where connectors for different voltages generally indicated at 71 may also be positioned, so as to provide an extremely versatile assembly which can adapt itself automatically to all conditions of use.

It may be appreciated from the above description that the invention achieves its objects and in particular the fact should be emphasized that the combined set has a single handgrip element, carrying the electric supply contacts, which is practically and readily positionable on the household appliance to be used, thus reducing bulk considerably.

Furthermore, the particular arrangement of the contacts allows the voltage change for the hair drier to be obtained merely by different positioning of the handgrip element relatively to the hair drier body, which positioning cannot originate incidental errors owing to the provision of the retainer element formed by the segment 60.

In practicing the invention, the materials used, so long as compatible with the specific use, and the dimensions and contingent shapes, may be any ones according to requirements.

We claim:

1. A combined set of household electrical appliances and a handgrip therefor, comprising:

a substantially tubular handgrip element a head portion laterally extending from said handgrip element at one end thereof and having a connection end laterally remote from said handgrip element, handgrip electric contacts at said connection end portion;

an electric cable having a free portion and an internal portion, said free portion protruding from said handgrip element and having a free end connected with an electric plug and said internal portion extending in said handgrip element and having a fixed end accomodated in said head portion and secured to said handgrip electric contacts;

switch means along said electric cable, said switch means having an accessible operating pushbutton;

a plurality of household appliances each having a main body with a connection portion;

an electric user in said main body of each of said household appliances;

a coupling element defined by said connection end of said handgrip head portion;

a coupling seat defined by said connection portion of said main body;

said coupling element and said coupling seat being mutually countershaped for removable connection therebetween;

main body electric contacts at said main body connection portion for mutual contact engagement with said handgrip electric contacts when said handgrip element is connected to said main body;

an electric circuit interposed between said electric contacts of said main body and said corresponding electric user;

wherein said cable comprises at least two supply wires, said handgrip electric contacts comprise at least first and second handgrip contacts, each handgrip contact being electrically connected to a respective one of said supply wires, said electric circuit comprises a voltage divider having at least two terminals and a central tap, and said main body electric contacts comprise at least first and second main body contacts connected to each other and to one of said terminals, a third main body contact connected to another one of said terminals and a fourth main body contact connected to said intermediate tap, said handgrip element and said main body being mutually rotatable among a first disengagement position wherein said handgrip electric contacts and said main body electric contacts are angularly offset, a first engagement position wherein said first handgrip contact faces and is electrically coupled with selectively one of said first and second main body contacts and said second handgrip contact faces and is electrically coupled with said third main body contact, and a second engagement position wherein said first handgrip contact faces and is electrically coupled with selectively another one of said first and second main body contacts, and said second handgrip contact faces and is electrically coupled with said fourth main body contact.

2. A combined set of household electrical appliances and a handgrip therefor, comprising:

a substantially tubular handgrip element a head portion laterally extending from said handgrip element at one end thereof and having a connection end;

handgrip electric contacts at said connection end laterally remote from said handgrip element;

an electric cable having a free portion and an internal portion, said free portion protruding from said handgrip element and having a free end connected with an electric plug and said internal portion extending in said handgrip element and having a fixed end accomodated in said head portion and secured to said handgrip electric contacts:

switch means along said electric cable, said switch means having an accessible operating pushbutton:

a plurality of household appliances each having a main body with a connection portion:

an electric user in said main body of each of said household appliances;

a coupling element defined by said connection end of said head portion;

a coupling seat defined by said connection portion of said main body;

said coupling element and said coupling seat being mutually countershaped for removable connection therebetween:

main body electric contacts at said main body connection portion for mutual contact engagement with said handgrip electric contacts when said handgrip element is connected to said main body;

an electric circuit interposed between said electric contacts of said main body and said corresponding electric user;

wherein said cable comprises at least two supply wires, said handgrip electric contacts comprise a first handgrip contact electrically connected to one of said supply wires, a second and a third handgrip contacts connected to each other and a fourth handgrip contact connected to another one of said supply wires, said electric circuit comprises a voltage divider having at least two terminals and two intermediate taps, and wherein said main body electric contacts comprise first and second main body contacts connected together and to one of said terminals, a third main body contact connected to one of said intermediate taps, a fourth main body contact connected to another one of said terminals and a fifth main body contact connected to another one of said intermediate taps, said handgrip element and said main body being mutually rotatable among a first disengagement position wherein said handgrip electric contacts and said main body electric contacts are mutually angularly offset, a first engagement position wherein said first handgrip contact faces and is electrically coupled with selectively one of said first and second main body contacts, said second handgrip contact faces and is electrically coupled with another one of said first and second main body contacts, said third handgrip contact is uncoupled, and said fourth handgrip contact faces and is electrically coupled with said fourth main body contact, and a second engagement position wherein said first handgrip contact faces and is electrically coupled with said another one of said first and second main body contacts, said second handgrip contact faces and is electrically coupled with said third main body contact, said third handgrip contact faces and is electrically coupled with said fourth main body contact and said fourth handgrip contact faces and is electrically coupled with said fifth main body contact.

3. A combined set household electrical appliances and a handgrip therefor, comprising:

a substantially tubular handgrip element, a head portion laterally protruding from said handgrip element and having a connection end remote from said handgrip element, handgrip electric contacts at said connection end, an electric cable having a free portion and an internal portion, said free portion protruding from said handgrip element and having a free end connected with an electric plug and said internal portion extending in said handgrip element and having a fixed end accomodated in said head portion and secured to said handgrip electric contacts, switch means along said electric cable, said switch means having an accessible operating pushbutton, an electric household appliance having a main body with a connection portion, an electric user in said main body, connector means provided at said connection portion of said main body and said connection end of said head portion of said handgrip element, said connector means defining a coupling means and a coupling seat mutually countershaped for mutual removable connection, main body electric contacts at said connection portion for mutual contact engagement with said handgrip electric contacts when said handgrip element is connected to said main body, and an electric circuit interposed between said main body electric contacts and said electric user, wherein said coupling means comprises at least a cylindrical projection having engagement wings projecting radially from said cylindrical projection, said coupling seat including a projecting cylindrical wall having a circular edge portion radially protruding from said wall toward said cylindrical projection when said handgrip element and said main body are mutually engaged, said edge portion defining a delimitation profile substantially countershaped to said cylindrical projection, said edge portion having engagement cutouts substantially countershaped to said engagement wings, and wherein said cable comprises at least two supply wires, said handgrip electric contacts comprise at least first and second handgrip contacts, each handgrip contact being electrically connected to a respective one of said supply wires, said electric circuit comprises a voltage divider having at least two terminals and a central tap, and said main body electric contacts comprise at least first and second main body contacts connected to each other and to one of said terminals, a third main body contact connected to another one of said terminals and a fourth contact connected to said intermediate tap, said handgrip element and said main body being mutually rotatable among a first disengagement position wherein said handgrip electric contacts and said main body electric contacts result mutually angularly offset, a first engagement position wherein said first handgrip contact faces and is electrically coupled with selectively one of said first and second main body contacts and said second handgrip contact faces and is electrically coupled with said third main body contact, and a second engagement position wherein said first handgrip contact faces and is electrically coupled with selectively another one of said first and second main body contacts, and said second handgrip contact faces and is electrically coupled with said fourth main body contact.

4. A combined set according to claim 3, wherein said circular edge portion defines a guide delimiting a rotation path for said wings, and said coupling seat further comprises wing rotation stopping means including a locking segment extending within said coupling seat close to said wall, elastic means acting on said locking segment to bias said locking segment in a rest position along said rotation path, an elongated opening in said wall, and a slider element rigidly connected to said locking segment and longitudinally slidable along said opening between a rotation limiting position, wherein said locking segment is in said rest position and engages with said wings for limiting rotation thereof, and a disengagement position, wherein said locking segment is remote from said rotation path and allows further rotation of said wings.

5. A combined set according to claim 3, wherein said handgrip electric contacts are arranged on a first circle, said main body electric contacts are arranged on a second circle corresponding to said first circle, and wherein said cable further comprises a ground wire, said handgrip electric contacts further comprise a handgrip ground contact connected to said ground wire and arranged centrally to said first circle, and said main body electric contacts further comprise a main body ground contact arranged centrally to said second circle.

* * * * *